United States Patent [19]

Oetiker et al.

[11] Patent Number: 4,466,542

[45] Date of Patent: Aug. 21, 1984

[54] SEPARATING CONTRIVANCE FOR CEREALS

[75] Inventors: Hans Oetiker, St. Gallen; Roman Müller, Niederuzwil, both of Switzerland

[73] Assignee: Gebruder Buhler AG, Uzwil, Switzerland

[21] Appl. No.: 346,012

[22] Filed: Feb. 5, 1982

[30] Foreign Application Priority Data

Feb. 23, 1981 [CH] Switzerland ..... 1170/81

[51] Int. Cl.[3] ..... B07B 9/00; B03B 4/00

[52] U.S. Cl. ..... 209/44.2; 209/2; 209/318; 209/467; 209/486

[58] Field of Search ..... 209/44, 312, 316, 318, 209/321, 466–469, 485, 486, 494, 2, 44.1, 44.2, 680, 682, 315

[56] References Cited

U.S. PATENT DOCUMENTS

| | | | |
|---|---|---|---|
| 1,548,536 | 8/1925 | Macartney | 209/469 X |
| 1,819,995 | 8/1931 | Davis | 209/467 |
| 2,014,249 | 9/1935 | Fletcher | 209/467 X |
| 2,040,196 | 5/1936 | Berrisford | 209/467 |
| 2,598,934 | 6/1952 | Ore et al. | 209/494 |
| 3,464,553 | 9/1969 | Hancock | 209/467 |

FOREIGN PATENT DOCUMENTS

| | | |
|---|---|---|
| 35-13622 | 9/1960 | Japan . |
| 491685 | 7/1970 | Switzerland . |
| 527002 | 10/1972 | Switzerland . |
| 547667 | 4/1974 | Switzerland . |
| 587687 | 5/1977 | Switzerland . |

OTHER PUBLICATIONS

Journal Tecnica Molitoria, (4 pp.), article, 1963.

*Primary Examiner*—Robert B. Reeves
*Assistant Examiner*—Edward M. Wacyra
*Attorney, Agent, or Firm*—Merchant, Gould, Smith, Edell, Welter & Schmidt

[57] ABSTRACT

A separating contrivance for separating cereals and similar grain product into at least three grain fractions and heavier impurities comprises two air-penetrable fluidized bed tables (2, 3) arranged one over the other and supported in fashion capable of being oscillated in relation to a frame, with a product inlet (9) leading to the upper fluidized bed table. At one end of the contrivance, and spaced away from the inlet (9), the upper fluidized bed table (2) is provided with outlets (10, 18) for the light and medium heavy grain fractions, while the lower fluidized bed table (3) includes outlet (27) for the heavy grain fraction. Adjoining the other end of the lower fluidized bed table (3) is an outlet (16) for the heavy impurities such as stones and the like. In order to achieve a practically complete sorting of the heavy impurities, provision is made so that the two fluidized bed tables (2, 3) are supported independently of one another and are driven by separate oscillating drives (7, 25).

27 Claims, 12 Drawing Figures

SEPARATING CONTRIVANCE FOR CEREALS

TECHNICAL FIELD

The present invention relates to a separating contrivance, for cereals and similar grain products, with two air-penetrable fluidized bed tables arranged one over the other and capable of being oscillated in relationship to a frame, with an inlet leading to the upper fluidized bed table and, at some distance away at one end of the contrivance, the upper fluidized bed table including an outlet for the light grain fraction, and the lower fluidized bed including an outlet for the heavy grain fraction, with an outlet for heavy impurities such as stones and the like lying at the opposite end of the contrivance.

BACKGROUND ART

A contrivance of this general type is, for example, known from Journal "Tecnica Molitoria", No. 6 of Mar. 30, 1963, page 133/136 and from Swiss Patent CH-PS 587 687. In the case of these contrivances, the two fluidized bed tables are arranged parallel and rigidly joined together by a common housing. A common oscillating drive induces in the fluidized bed tables an oscillatory casting motion that is the same in direction, amplitude and frequency. If the inclination of the fluidized bed tables and the oscillatory casting motion are optimally tuned to the lower fluidized bed table, disturbance of material flow in the upper fluidized bed table can occur. If the inclination of the fluidized bed tables and the oscillatory casting motion are optimally tuned to the upper fluidized bed table, there then exists the danger that larger quantities of stones will be carried along with the remaining grain product.

The Japanese Patent Sho-35-13622 shows another similar contrivance, with two air-penetrable separation tables capable of being oscillated in relationship to a frame, forming an oscillatory unit with a common vibrator. As is given in this publication, three different fractions are formed over appropriate outlets whereby, however, both a fine and coarse fraction of impurities (dust and sand) with only one fraction of grain product is formed. This solution would be capable of being used in the preparation of cereals only for obtaining two grain fractions when there would be two grain parts of different size in the cereal that are capable of being separated by a purely sifting process. This seldom occurs in the case of cereals. Most often, a light grain fraction (shriveled kernels, etc.) must be separated from the good kernels. The shriveled kernels are not very different from other kernels in outside dimensions: they are, however, much lighter.

The actual standard for sorting out heavier impurities from the cereals is given, today, by solutions corresponding to Swiss Patent CH-PS 491 685. In the separating contrivance in accordance with this publication, also used, in principle, are two separation tables: here, however, these are next to each other. The product is layered into a heavy and light fraction in a first air-penetrable channel, and then the two layers are passed over to the second separating table for separation into a heavy fraction and a light fraction. In the greater number of cases, however, sorted out as the heavy fraction are only the stones, glass, etc., so that here also, as in the case of the Japanese Patent Sho-35-13622, only one cereal fraction is actually obtained.

As a general rule, no absolute values can be achieved in practice; this applies particularly for the separation of grain product and/or cereals into several fractions. The practical maximum in the case of sorting out stones is assumed to be in a flowthrough water bath, since, in water, the difference of weight between cereal grain and stones can be utilized especially well because the stones simply sink to the bottom. Actually, however, as good a result as with the water bath is achieved with the solution in accordance with Swiss Patent CH-PS 491 685.

For separating the cereal into two fractions, a heavy grain fraction and a light grain fraction, two contrivances have been used: the so-called Concentrator in accordance with Swiss Patent CH-PS 547 667 for example, and the light grain sorter in accordance with Swiss Patent CH-PS 527 002.

Although an attempt has been made for decades to sort out the three principal fractions from cereals; namely heavy grain, light grain and stones, with a single machine, up until the present time no solutions have been found that achieve the quality standard of the contrivances in accordance with Swiss Patents CH-PS 491 685, 547 667 and 527 002.

SUMMARY OF THE INVENTION

The object of the invention is to eliminate the deficiencies of the aforementioned contrivances and to develop a separating contrivance that attains as high an operational quality as the best individual machines known up until now:

- a clean separation into light and heavy grains, and
- a practically complete sorting of stones; along with manufacturing costs that are substantially lower than the total price of two of the individual contrivances that have been best up until now.

In accordance with a preferred embodiment of the invention, provision can be made so that the inclination of at least the lower fluidized bed table is adjustable with adjustment means. This brings about the advantage that stone sorting quality, responding in more sensitive fashion to the inclination of the fluidized bed table, can be optimized without, in so doing, influencing the quality of light grain sorting.

Further, the direction of oscillation of each oscillating drive can be directed through the center of gravity of the associated fluidized bed table, the angle between the plane of the fluidized table and the direction of oscillation of the oscillating drive being adjustable. Resulting from this is the advantage that an oscillatory casting motion uniform in direction of oscillation and amplitude can be imparted to each fluidized bed table over its entire surface, such that optimization of sorting quality, at least on the lower fluidized bed table, is possible by adjustment of the angle.

In order to be able to close off the intermediate space between the fluidized bed tables by means of a labyrinth seal, provision can be made so that the directions of oscillation of the two fluidized tables lie in a vertical plane that cuts the planes of the fluidized tables at a right angle.

Preferably, the oscillatory drive of the upper fluidized bed table acts from the inlet toward the outlet for the light grain fraction, with the oscillating drive of lower fluidized table acting from the outlet for the heavy grain fraction toward the outlet for the heavy impurities. Capable of being achieved in this fashion, with assurance of a high sorting quality, is a high throughput capacity.

In accordance with a preferred embodiment of the invention, the fluidized bed tables are arranged in an enclosed and laterally limited housing that is provided with at least one air inlet opening under the lower fluidized bed table, and above the upper fluidized bed table with at least one air outlet opening. The housing includes a movable section of wall between the two fluidized bed tables. This construction brings about the advantage of being able, with a single blower or suction-air source, to feed both fluidized bed tables with one stream of air. If the movable partition is formed by a bellows, there then results the advantage that, in spite of the closed housing, the fluidized bed tables are individually inclinable. Furthermore, they can be driven with oscillatory casting motions of different direction, frequency and amplitude.

In order to achieve a clean layering of the product in the fluidized bed prior to the start of separating into fractions, provision can be made so that the upper fluidized bed table is divided, in the direction from the inlet toward the outlet for the light grain fraction, into two sequentially arranged regions of different size perforations so that the desired grain fraction can fall through the fluidized bed table only into the regions following the first region.

If a slot or an area of coarse perforation adjoins the first region, transversely over the fluidized bed table, then the stones can be separated out closer to the stone outlet of the lower fluidized bed table. This effect is improved by having a threshold extend, adjacent to the slot and/or zone of coarse perforation, and transversely over the fluidized bed table.

Deposit of the stones and other heavy impurities as close as possible to the stone outlet of the lower fluidized bed table can be accomplished by providing, under the upper fluidized bed table, a slide angling toward the stone outlet and passing below the slot and/or zone of coarse perforations. Further optimizing of the quality of stone sorting can be achieved at the same time by making the slide adjustable between the slot and/or the zone of coarse perforation and the outlet for the light grain fraction. It is particularly advantageous if the slide ends in the region of the stone outlet.

In accordance with another embodiment, provision is made for mounting, in the second region of the upper fluidized bed table, mutually adjustable sidewalls that are pivotable at their ends facing toward the outlet for the light grain fraction, for the purpose of tapering, in a wedge-like fashion, the effective surface area of the upper fluidized bed table toward the outlet for the light grain fraction. In this way, the effective surface are of the upper fluidized bed table can be adjusted such that there results a uniformly high fluidized bed and a correspondingly uniform separation of the grain fractions.

Preferably, provision is made so that the inlet includes a distributor mechanism extending over the width of the upper fluidized bed table. In this fashion, the upper fluidized bed table surface is optimally employed in that a uniform fluidized bed is established immediately out from the outlet, whereby the upper fluidized bed table can be maintained small.

Preferably, the upper fluidized bed table is divided, in the direction from the inlet toward the outlet for the light grain fraction, into a plurality of perpendicular zones adjoining one another, with means being provided for the purpose of being able to set individually the quantity of air flowing through the fluidized bed table into each zone. This individual adjustment capability for the throughflowing quantity of air enables a high uniformity in the structure of the fluidized bed, which is achieved in simpler fashion by having the means display, over the fluidized bed table, perpendicularly arranged walls that divide the space over the zones into chambers that adjoin one another, with the flow-through cross section of each chamber capable of being adjusted by means of a displaceable throttling damper. By means of this construction, expensive baffles below the table plane of the upper fluidized bed table are unnecessary.

Provision can be made so that the distance from the lower limit of the walls to the plane of the upper fluidized bed table amounts to between about $\frac{1}{3}$ and 1/10 of the distance between the planes of the two fluidized bed tables. Capable of being obtained in this fashion is a uniform flow of air through the upper fluidized bed table, which in turn facilitates control of the flow of air through the lower fluidized bed table. While still retaining this advantage, the separating contrivance can be kept low if the distance from the lower limit of the walls to the plane of the upper fluidized bed table amounts to at least about 1.5 cm, preferentially approximately 2 cm.

Further, capable of being arranged between the fluidized bed tables and under the second region is another floor extending over its width, at least approximately parallel to the upper fluidized bed table, whereby, at the end of the floor lying opposite the inlet, there adjoins a further outlet for a medium-heavy grain fraction. In this fashion, sorting of another grain fraction is possible with the quality of this fraction being controlled in simple fashion by making the length of the floor from the outlet for the medium-heavy grain fraction adjustable in the direction toward the inlet.

BRIEF DESCRIPTION OF THE DRAWING

The invention will now be explained with reference to the accompanying Drawing, wherein.

DETAILED DESCRIPTION

Figure 1:
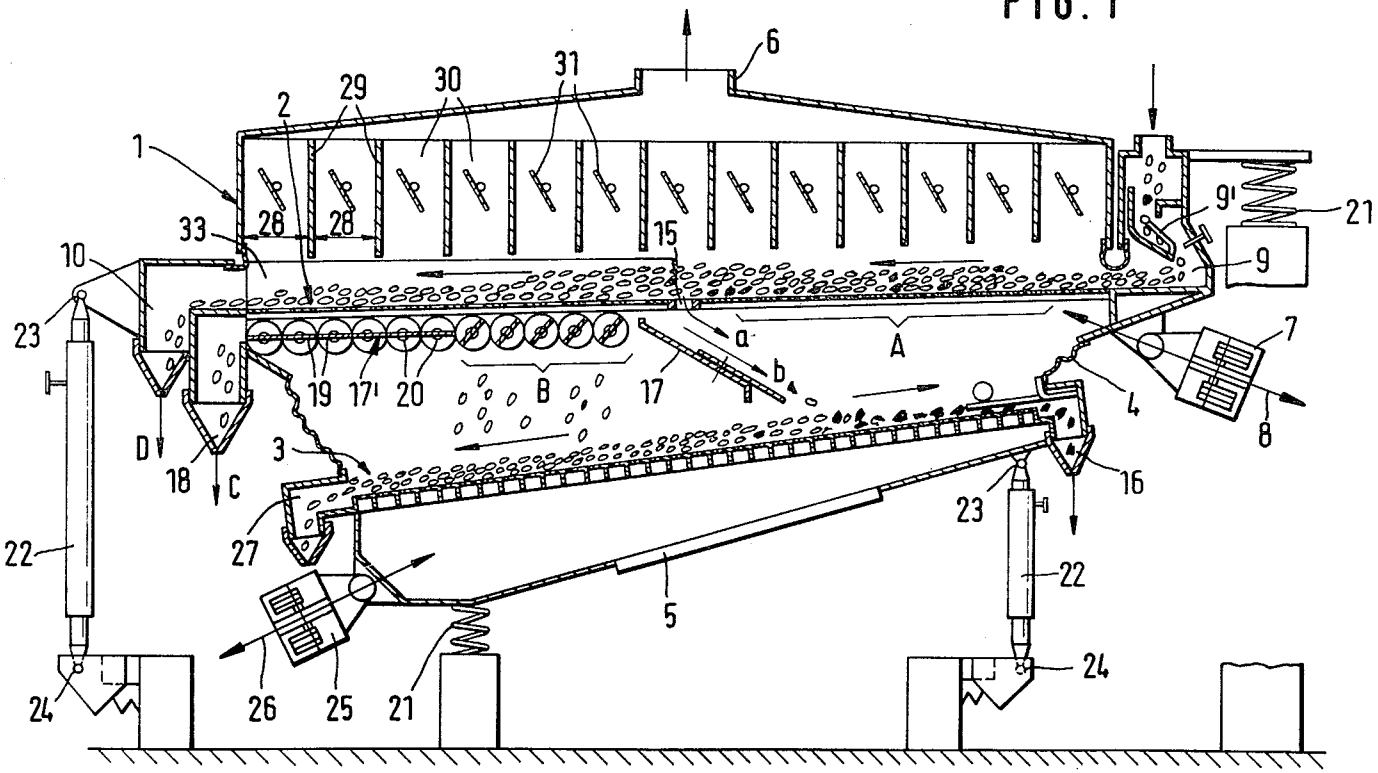
FIG. 1 is a vertical longitudinal view through a first embodiment of a separating contrivance, incorporating the invention.

In the case of the embodiment shown in accordance with FIG. 1, arranged vertically over one another inside a housing 1 are two fluidized bed tables 2 and 3.

The housing 1 is provided, between the fluidized bed tables 2 and 3, with a movable wall section or portition in form of a flexible bellows 4 so that the fluidized bed tables 2 and 3 can execute, relative to one another, different motions relative to the setting of their inclinations and relative to the setting of their casting motion. The housing 1 is provided, under the lower fluidized bed table 3, with an air inlet opening 5, and with, above the upper fluidized bed table 2, an air outlet opening 6 that is connected to a source of suction air that is not represented. The air aspirated through the outlet opening 6 passes through the air inlet opening 5 into the housing 1 and then flows through, one after the other, first the lower fluidized bed table 3 and then the fluidized bed table 2 lying above it.

The upper fluidized bed table 2 is firmly joined with the surrounding housing and supported in a fashion capable of being oscillated inside a fixed machine stand that is not illustrated further. Connected to the upper fluidized bed table 2, on the outside of the housing, is an oscillating drive 7 whose direction of oscillation 8 extends through the center of gravity of the upper fluidized bed table. Arranged at one end of the upper fluidized bed table 2 is a cereal or product inlet 9 that extends across the entire width of the upper fluidized bed table 2 and distributes the product uniformly over the entire width of the table with a distributor mechanism 9'. Installed at its opposite end is a light grain outlet 10 through which the shriveled kernels, seeds and the like exit.

Figure 2:
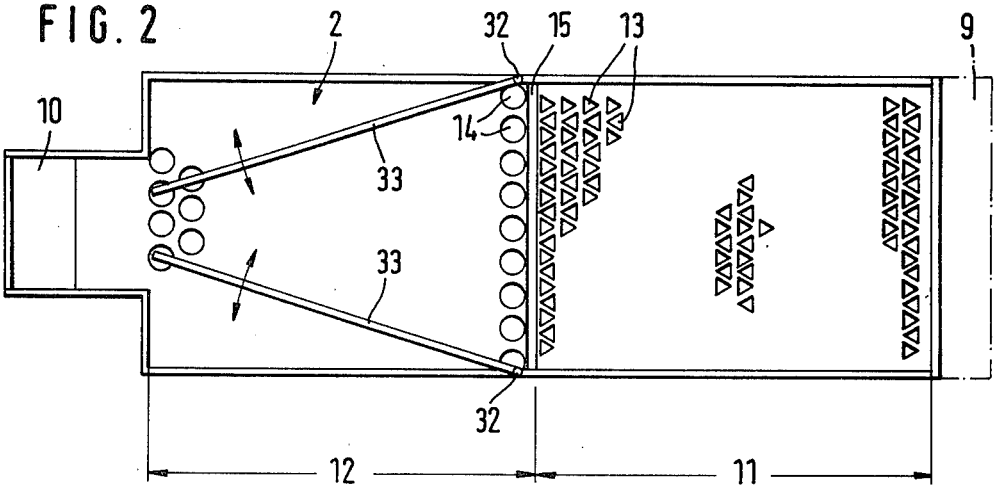
FIG. 2 is a top vie of the upper fluidized bed table of the separating contrivance in accordance with FIG. 1.

The upper fluidized bed table 2 is slightly downwardly angled, and adjustable in its inclination, from the product inlet 9 toward the light grain outlet 10. Further, in the direction from the product inlet 9 toward the light grain outlet 10, the table surface of the fluidized bed table 2 is divided into two sequentially arranged perforate regions 11 and 12 (FIG. 2). In the first region 11, the diameter of the holes 13 penetrating the table surface is selected small enough so that no kernels can fall through them onto the lower fluidized bed table 3. In doing this, however, it is permissible that sand or dust-like impurities of heavy particles already fall, in the first region 11, through the upper fluidized bed table 2, which does not impair the separating quality but rather favors it. In the first region 11, the grain product forms a fluidized bed in which the heavy impurities can sink downwardly and the light grains can rise upwardly.

Because of the inclination and the oscillatory casing motion of the upper fluidized bed table 2, this fluidized bed flows, in the stratification mentioned, onto the following region 12 having holes 14 that penetrate the table surface and are large enough so that the grains can fall through them onto the lower fluidized bed table 3. In the second region 12, falling through the holes 14 first are predominatly the heavy impurities, then predominatly the heavy grains and finally the greater part of the medium-heavy grains, whereas the light grains swim away on the fluidized bed toward the light grain outlet 10.

In order to permit the heavy impurities, such as stones, shards and the like that are sinking downwardly in the fluidized bed in the first region 11, to fall as rapidly as possible onto the lower fluidized bed table 3, a transverse slot 15 is arranged between the two regions 11 and 12 and perpendicular to the flow direction of the fluidized bed, through which slot fall the downwardly deposited stones from the first region 11. In order to be able to cast off the stones falling through the slot 15 and those falling through the holes 14 at the beginning of the second region 12 as close as possible to the stone outlet 16 and onto the lower fluidized bed table 3, a slide 17 is provided that extends below the slot 15 toward the stone outlet 16 and that is inclined toward this outlet. In this fashion, most of the heavy impurities are brought close to the stone outlet 16, which facilitates separation by the lower fluidized bed table 3 and raises the quality of separation. The slide 17 is preferably constructed to be adjustable lengthwise in order that transfer of the heavy impurities onto the lower fluidized bed table 3 can be optimally adjusted.

Arranged below the end of the second region 12 of the upper fluidized bed table 2 that abuts the light grain outlet 10 and at some distance from the bed table, is a second floor 17', (FIG. 1) that extends in the direction toward the first region 11 and that is longitudinally adjustable in this direction. Adjoining the lower-lying end of the second floor 17' is an outlet 18 for the medium-heavy grains.

The floor 17' is preferably formed by parallel adjustable dampers 19 that are supported with end-side axle journals 20 inside housing 1, capable of being pivoted by 90°. The dampers 19 can be swung out from a position parallel to the upper fluidized bed table 2 into a right angle position to this latter by means of rotary knobs affixed to the axle journals 20. In the first position, the dampers 19 adjoin one another and form the continuous floor 17'. The length of the floor 71' can now be adjusted by swinging one or more of the dampers 19 that are some distance away from the outlet 18 out from the position that is parallel to the upper fluidized bed table 2 into a position that is a right angle thereto. Depending upon the pivoted position of the dampers 19, the grains falling through in the region 12 of the upper fluidized bed table 2 fall either onto the lower fluidized bed table 3 or onto the floor 17'. In the first case, they are subjected, on the lower fluidized bed table 3, to a further separating process, while in the second case, on the other hand, the grains falling through region 12 slide on the floor 17' toward the outlet 18. They can there be carried off or conveyed back to the inlet 9.

The lower fluidized bed table 3 is likewise firmly joined with the housing 1 that surrounds it, and joined, via an oscillating support, with the fixed machine stand that is not illustrated in more detail. As in the case of the upper fluidized bed table 2, the oscillating support consists on the one hand of coil springs 21 and on the other hand of a longitudinally adjustable toggle joint 22 that is connected via links 23 and 24, respectively, with the housing 1 and the machine stand. The inclination of the upper as well as of the lower fluidized bed table 2 and/or 3 can be set by an adjustment of the length of the toggle joint 22.

Arranged at housing 1 is a second oscillating drive 25 connected to the lower fluidized bed table 3, the direction of oscillation 26 of which is adjustable such that it cuts the center of gravity of the lower fluidized bed table 3. Further, the oscillating drive 25 can be displaced relative to the lower fluidized bed table 3 such that the angle included by the direction of oscillation 26 with the plane of the fluidized bed table 3 can be adjusted in order to optimize the separating quality on the lower fluidized bed table 3.

The table surface of the lower fluidized bed table 3 is formed by a perforated plate, a screen or the like, the perforation of which is so small that the grain product and the heavy impurities (aside from a possible heavy dust proportion) cannot fall through. Below the inlet 9, at one end the lower fluidized bed table 3 opens out into the stone outlet 16, with the heavy grain outlet 27 adjoining its opposite end.

The grain product arriving through the upper fluidized bed table 2 and appearing on the lower fluidized bed table 3 is again transformed into a fluidized bed in which the heavy impurities deposit themselves downwardly and over which, corresponding to the lower suspension velocity, the heavy grains dispose themselves. Occassioned by the inclination of the fluidized bed table 3, the lighter grain fraction swim toward the heavy grain outlet 27, whereas the heavy impurities are transported toward the stone outlet 16 under the effect of the oscillatory casting motion of the oscillating drive 25, and are carried out there.

In order to facilitate formation of a uniform fluidized bed on the upper fluidized bed table 2, its table surface is divided into zones 28 (FIG. 1) oriented perpendicularly to the direction of conveyance. Corresponding to these zones 28 that divide the hollow space above the upper fluidized bed table into chambers 30. Arranged in each chamber 30 is an adjustable throttling damper 31 rotatably supported in housing 1 by end-side axle journals. Each throttling damper 31 can be swivelled into any arbitrary pivot position with rotary grips installed on the axle journals outside the housing 1. The width of each throttling damper 31 corresponds to the width of a chamber 30, so that the flowthrough of air through a chamber 30 can be totally blocked or completely free. A uniform passage of air through the upper fluidized bed table 2 can thus be obtained by individual adjustment of the throttling dampers 31. This can be achieved in advantageous fashion by having the distance from the underside of the perpendicular walls 29 to the table surface of the upper fluidized bed table amount to at least about 1.5 cm and preferably approximately 2 cm. In order that the contrivance be capable of construction with less height and without the flowthrough of air through the upper fluidized bed table 2 being influenced by the flowthrough of air through the lower fluidized bed table 3, the distance from the underside of the perpendicular walls 29 to the table surface of the upper fluidized bed table amounts, in an approximation, to 1/10, at most, however, $\frac{1}{3}$ of the average distance between the two table surfaces of the fluidized bed tables 2 and 3.

As a further measure for achieving a fluidized bed that is uniform in height on the upper fluidized bed table 2, available in the second region 12 are lateral side rails or walls 33 capable of being pivoted about pivoting axes 32, with which the effective surface area of the second region 12 can be made smaller in correspondence to the decrease of the fluid bed volume. Adjustment of these lateral walls 33 can be accomplished by spindles capable of being actuated from outside housing 1, which spindles are not illustrated.

The mechanism of FIGS. 1–2 described above and 3 as follows. The grain product containing multiple grain fractions and heavy impurities is fed onto the upper fluidized bed table 2 through the inlet 9 and distributed thereupon by the distributing mechanism 9'. Induced in the table 2, with a slight inclination toward the light grain outlet 10, by means of the oscillating drive 7, is an oscillatory casting motion in the direction of flow. As a consequence of the vacuum acting upon the suction connection 6, both fluidized bed tables 2 and 3 are penetrated vertically by a stream of air. The grain product spreading out on the upper fluidized bed table 2 forms a fluidized bed, with a uniform flowthrough of air being accomplished in the upper fluidized bed table 2 by adjusting the throttling dampers 31. At region 11 of the upper fluidized bed table 2 that adjoins the inlet 9, an undisturbed fluidized bed is formed in which the heavy impurities and the grain product can be layered over one another corresponding to their velocity of floating. If the fluidized bed reaches slot 15, the width of which is dimensioned such that both the heavy impurities and also some grain product can pass through, then the heavy impurities and heavy grains lying at the bottom in the fluidized bed fall through the slot 15 onto the slide 17. In turn, falling out of the further-flowing fluidized bed, in the second region 12, onto the lower fluidized bed table 3 or onto the floor 17', are the lower-lying heavy grains. The light grains not falling through either the first region 11 or the second region 12 flow to the light grain outlet 10, whereas the grains falling onto the floor 17' are discharged through the outlet 18.

Of the heavy grains and heavy impurities falling onto the lower fluidizing bed table 3, the greater portion thereof falls onto the slide 17 and is deposited near the stone outlet 16 onto the lower fluidized bed table 3. Forming anew on the lower fluidized bed table is a fluidized bed in which the heavy impurities sink downwardly and are conveyed, under the effect of the oscillatory casting motion imparted to table 3 by drive 25, to the stone outlet 16. In contrast to this, the above-lying grains swim downhill toward the heavy grain outlet 27 and are removed there. The quality of the work of separation on the lower fluidized bed table 3 is optimized by an adjustment of the inclination with the toggle joint 22 and by adjustment of the oscillatory casting motion, based on the parameters of inclination, frequency and amplitude.

Figure 3:
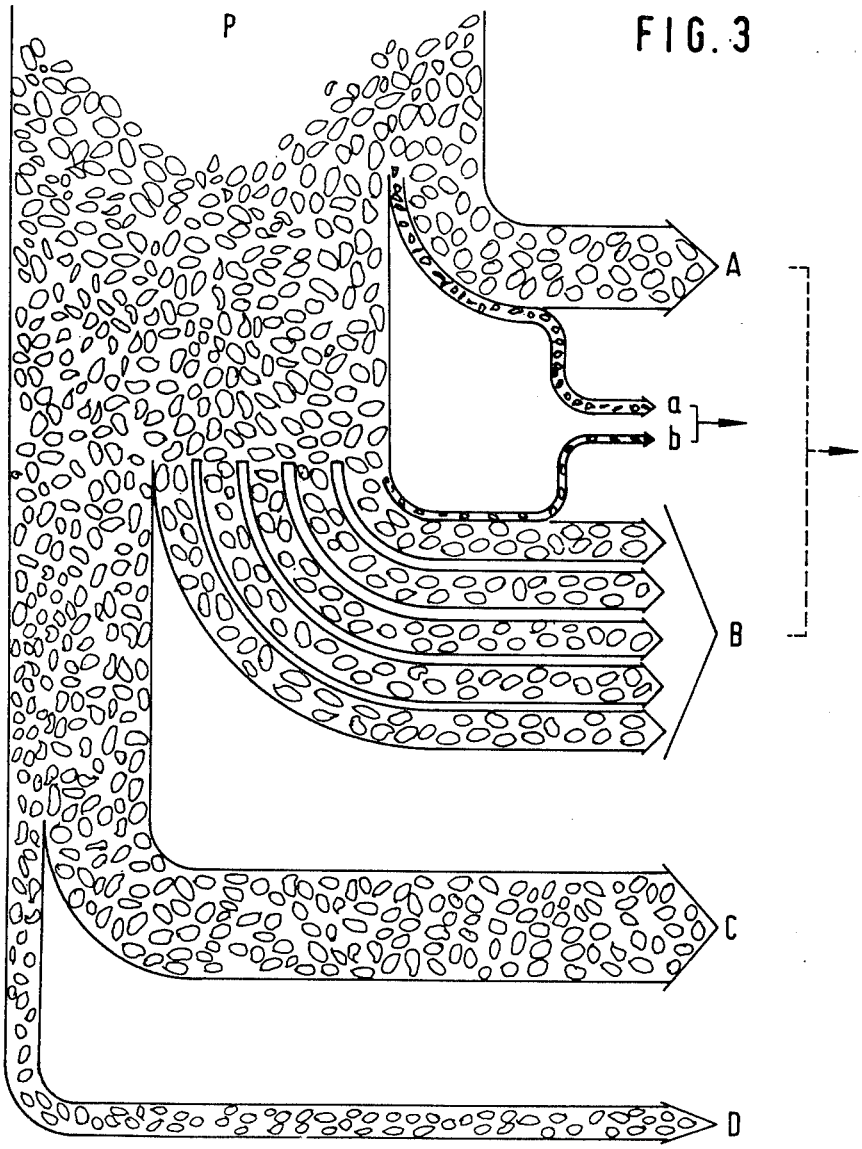
FIG. 3 is a schematic illustration of material flow to the separating contrivance in accordance with FIG. 1.

As is apparent from FIGS. 1 and 3, those grains and impurities are subjected to a further processing on the lower fluidized bed table 3, which fall downwardly in the areas A, B as well as a and b, through the upper fluidized bed table 2. The light grains D or medium-heavy grains C coming out through the outlets 10 and 18 are removed or, if necessary, brought back again to the inlet 9 for another pass through the contrivance.

Figure 4:
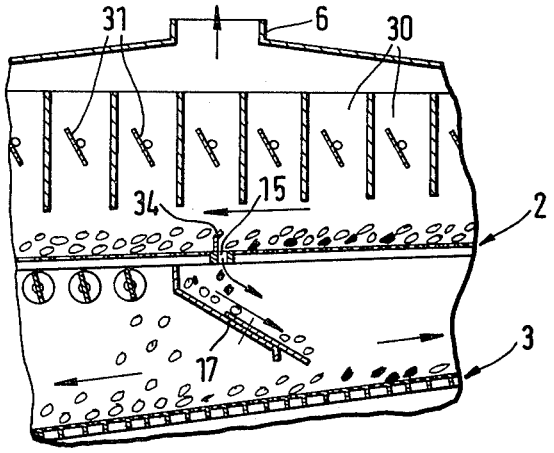
FIG. 4 is a partial view from FIG. 1 with a second variant of the first embodiment of the invention.

In accordance with FIG. 4, a threshold 34, on the upper fluidized bed table 2, can adjoin the slot 15 in the direction of flow of the fluidized bed. This threshold forces the heavy portions settling in the first region 11 through the slot 15, downwardly onto the slide 17 and, from there, onto the lower fluidized bed table 3, respectively. Installation of the threshold 34 is desirable when a high throughput capacity is required of the separating contrivance without loss of quality of the work of separation.

Figure 5:
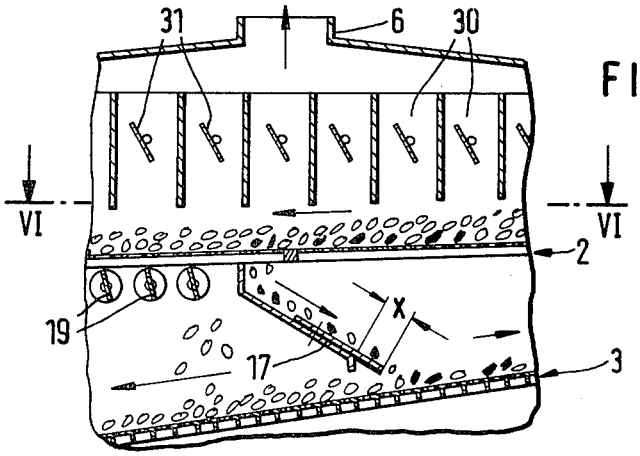
FIG. 5 is a partial view from FIG. 1 with a third variant of the first embodiment of the invention.
Figure 6:
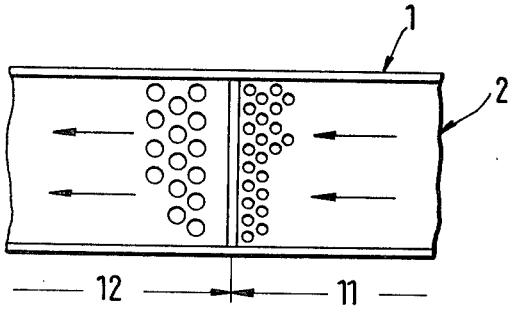
FIG. 6 is a sectional view taken along line VI—VI in FIG. 5.

As FIGS. 5 and 6 show, the slot 15 can be eliminated between the two regions 11 and 12 when the throughput capacity required of the separating contrivance is relatively small. Under this condition, elimination of the slot 15 causes no loss in the quality of the work of separation.

Figure 7:
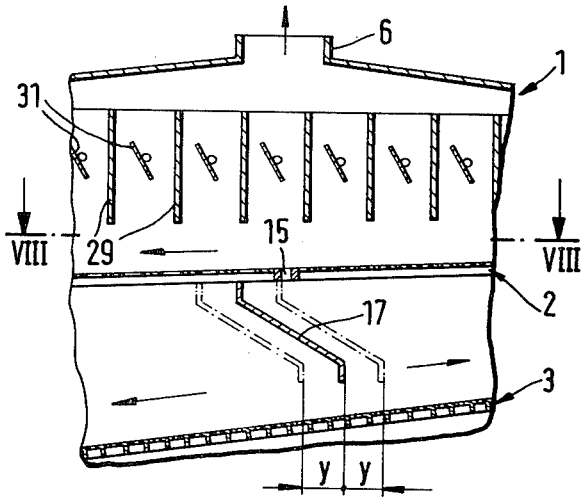
FIG. 7 is a partial view from FIG. 1 with a fourth variant of the first embodiment of the invention.

In accordance with FIG. 7, the quality of the work of separation can also be influenced by making the slide 17 displaceable, and lockable in any position spaced away from slot 15, in the direction toward the light grain outlet 10. The position of the slide 17 determines how much of the heavy grains or heavy impurities passing through the second region 12 of the upper fluidized bed table 2 to capture and to conduct from the slide toward the stone outlet 16. This adjustability of the slide 17 is advantageous when alternately greater or lesser throughput capacities, with constant quality of work of separation, are required of the separting contrivance, or when, during different steps of processing, qualitative and/or quantitative differences in the grain product are noticed in the case of heavy impurities.

Figure 8:
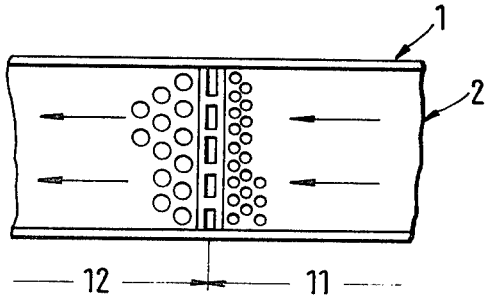
FIG. 8 is a partial view taken along line VIII—VIII in FIG. 7.

As FIG. 8 shows, slot 15 need not be a far-reaching opening. It is sufficient if a zone of comparatively coarse perforation is arranged in the region of the slot 15.

Figure 10:
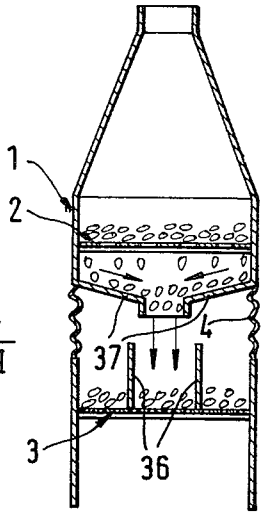
FIG. 10 is a sectional view taken along line X—X in FIG. 9.
Figure 9:
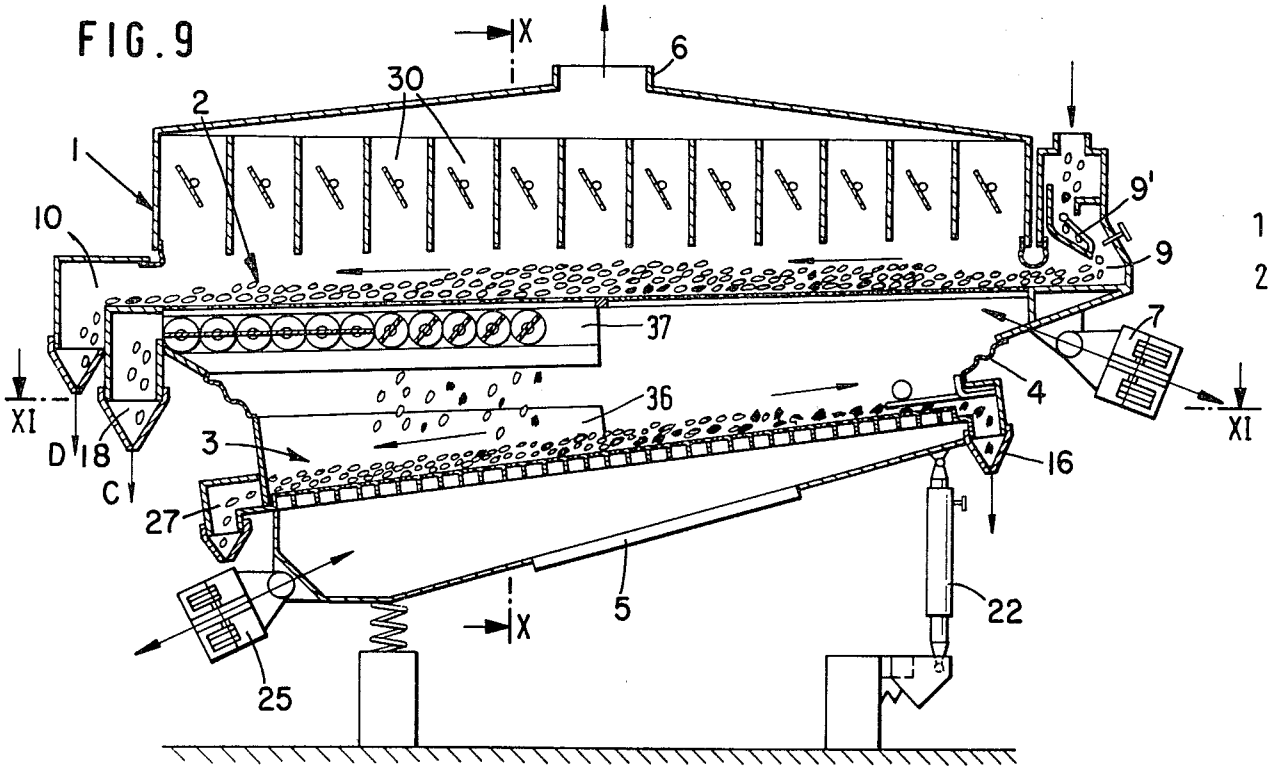
FIG. 9 is a similar to FIG. 1 showing a second embodiment of the invention.
Figure 11:
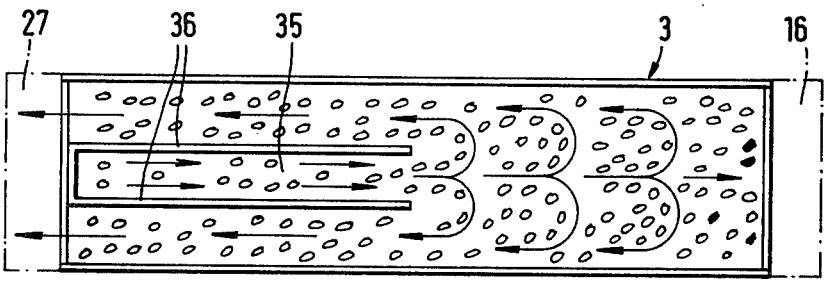
FIG. 11 is a sectional view taken along line XI—XI in FIG. 9.

In the inventive embodiment according to FIGS. 9, 10 and 11, both the slot 15 and the slide 17 are lacking. Instead of these components, a pre-loading channel 35 on the lower fluidized bed table 3 is limited by two parallel walls 36, into which the product falling through the upper fluidized bed table 2 is conducted by two sheet metal guides 37. The deposited grain product is converted into a fluidized bed over the entire lower fluidized bed table 3, including the pre-loading channel 35. The fluidized bed thereby formed in the pre-loading channel 35 between walls 36 first flows in the direction of the sketched-in arrows (FIG. 11) toward the stone outlet 16. In doing this, the heavy impurities and the heavy grains, corresponding to their greater floating velocity, sink downwardly, whereas the lighter grain fractions climb upwardly in the region of the bed surface. The length of the pre-loading channel 35 is advantageously selected to be great enough so that this load, in the fluidized bed flowing therein up to the channel opening, is very complete, in accordance with the velocity of floating, in order that this prelayered floating bed in this stratification can pass over onto the remaining table area of the fluidized bed 3 unchanged. In doing this, the lighter grains undergo a directional reversal of 180°, shown by the sketched-in arrows in FIG. 11, whereas the heavy impurities are conveyed further toward the stone outlet 16, essentially rectilinearly, under the effect of the oscillatory casting motion. The grains freed from the heavy impurities, swimming away downhill on the lower fluidized bed table 3, reach the heavy grain outlet 27. The lower fluidized bed table 3 can be limited toward the heavy grain outlet 27 by a retaining threshold (not illustrated) which prevents heavy impurities being carried along by the heavy grains.

Figure 12:
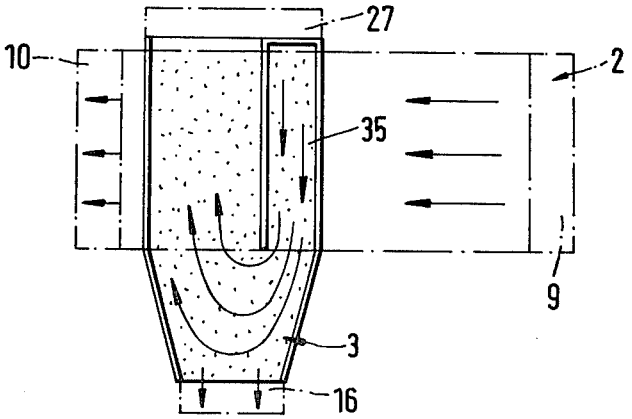
FIG. 12 is a top view of a third embodiment of the invention.

In principle, the embodiment shown in FIG. 12 corresponds to that in accordance with FIGS. 9 to 11. In the case of this particular embodiment, however, the pre-loading channel 35 is offset to one side of the lower fluidized bed table 3. The longitudinal axis of the upper fluidized bed table 2 is here rotated, relative to that of the lower fluidized bed table 3, by 90°, whereby, by means of sheet metal guides that are not illustrated, the grains falling through the upper fluidized bed table 2 are deflected into the pre-loading channel 35. Taking place in this latter is again a pre-loading, and the product coming out from the preloading channel 35 is transferred in this stratification on to the remaining table area of the fluidized bed table 3 unchanged. Here, the heavy impurities wander further toward the stone outlet 16, with only slight change in direction, whereas the grains freed from the heavy impurities undergo directional reversal of 180° and migrate toward the heavy grain outlet 27.

We claim:

1. Separating contrivance for cereals and similar grain product, comprising:

two air-penetrable, inclined fluidized bed tables arranged one over the other and separately supported for independent oscillation in relation to a frame;

means defining an inlet leading to one end of the upper fluidized bed table;

means defining a first outlet spaced from the inlet for receiving the light grain fraction from the upper fluidized table;

means defining a second outlet between the inlet and first outlet for receiving the heavy grain fraction from the upper fluidized table;

means located at one end of the lower fluidized table for defining a third outlet for receiving heavy impurities such as stones and the like;

means located at the other end of the lower fluidized bed table for defining a fourth outlet for receiving the heavy grain fraction from said lower fluidized bed table;

means for independently supporting said fluidized bed tables;

first drive means for oscillating said upper fluidized bed table in a predetermined direction; and second drive means for oscillating said lower fluidized bed table in another predetermined direction.

2. Separating contrivance in accordance with claim 1, wherein the inclination of at least the lower fluidized bed table is adjustable.

3. Separating contrivance in accordance with claim 1, wherein the direction of oscillation of each oscillating drive means is directed through the respective center of gravity of the associated fluidized bed table, and wherein the angle between the plane of the lower fluidized bed table and the direction of oscillation thereof is adjustable.

4. Separating contrivance in accordance with claim 1, wherein the directions of oscillation of said fluidized bed tables lie in an upright plane that intersects the planes of said fluidized bed tables at a right angle.

5. Separating contrivance in accordance with claim 4, wherein said upper fluidized bed table is effectively oscillated from the inlet toward the first outlet.

6. Separating contrivance in accordance with claim 4, wherein said lower fluidized bed table is effectively oscillated from the third outlet toward the fourth outlet.

7. Separating contrivance in accordance with claim 1, wherein said fluidized bed tables are arranged in a closed and laterally limiting housing, which includes at least one air inlet below said lower fluidized bed table and at least one air outlet opening above said upper fluidized bed table, said housing further including a movable wall section between said fluidized bed tables.

8. Separating contrivance in accordance with claim 7, wherein the movable wall section is formed by bellows.

9. Separating contrivance in accordance with claim 1, wherein said upper fluidized bed table is divided between the inlet and the first outlet into at least two sequential regions of different predetermined perforations such that the heavy grain fraction and heavy impurities can fall from said upper fluidized bed table only through said regions.

10. Separating contrivance in accordance with claim 9, wherein a slot or zone of relatively coarser perforations extends between the regions across said first fluidized bed table.

11. Separating contrivance in accordance with claim 10, wherein a threshold extends adjacent to the slot or the zone of relatively coarser perforations across said upper fluidized bed table.

12. Separating contrivance in accordance with claim 11, wherein there is provided, under said upper fluidized bed table, a slide passing below the slot or the zone of relatively coarser perforations and angling toward the third outlet.

13. Separating contrivance in accordance with claim 12, wherein said slide is adjustable relative to the slot or the zone of relatively coarser perforations.

14. Separating contrivance in accordance with claim 9, wherein there is provided, in the second region of the upper fluidized bed table adjustable side walls pivotable at their ends facing toward the inlet for the purpose of tapering wedge-fashion the effective surface area of the upper fluidized bed table toward the first outlet.

15. Separating contrivance in accordance with claim 1, wherein the inlet includes a distributing mechanism extending across the upper fluidized bed table.

16. Separating contrivance in accordance with claim 1, wherein the upper fluidized bed table is divided between the inlet and the first outlet into a plurality of adjoining zones, including damper means for individually adjusting the quantity of air flowing through the upper fluidized bed table and into each zone.

17. Separating contrivance in accordance with claim 16, wherein the zones, over the upper fluidized bed table is defined by perpendicularly arranged walls that separate the space over the zones into separate chambers adjoining with the flowthrough cross section of each chamber being adjustable by said damper means.

18. Separating contrivance in accordance with claim 17, wherein the distance between the lower ends of the walls and the plane of the upper fluidized bed table is between about $\frac{1}{3}$ and 1/10 of the distance between the planes of the two fluidized bed tables.

19. Separating contrivance in accordance with claim 18, wherein the distance between the lower ends of the walls and the plane of the upper fluidized bed table is between about 1.5 cm and 2 cm.

20. Separating contrivance for cereals and similar grain product, comprising:

two air-penetrable, inclined fluidized bed tables arranged one over the other and capable of being oscillated in relation to a frame;

means defining an inlet leading to one end of the upper fluidized bed table;

said upper fluidized bed table being divided between the inlet and the first outlet into at least two sequential regions of different predetermined perforations such that the heavy grain fraction and heavy impurities can fall from said upper fluidized bed table only through said regions;

means defining a first outlet spaced from the inlet for receiving the light grain fraction from the upper fluidized table;

means defining a second outlet between the inlet and first outlet for receiving the heavy grain fraction from the upper fluidized table;

means located at one end of the lower fluidized table for defining a third outlet located at one end of the lower fluidized table outlet for receiving heavy impurities such as stones and the like;

a floor arranged between the fluidized bed tables and extending generally parallel to the upper fluidized bed table from beneath the second region to the second outlet;

means for independently supporting said fluidized bed tables for oscillation individually from each other; and means for separately driving each fluidized table in oscillating fashion.

21. Separating contrivance in accordance with claim 20, wherein the length of the floor is adjustable in the direction toward the inlet.

22. Separating contrivance in accordance with claim 21, wherein the floor is formed by a plurality of flat profiles that are rotatably journaled about their longitudinal central axes within a housing, with the flat profiles adjoining one another in the case of coplanar alignment.

23. Contrivance for separating grain products into multiple grain fractions and impurities, which comprises:

upper and lower fluidized bed tables located in superposed relationship each of said fluidized bed tables being inclined and having an upper end and relatively lower opposite end;

means for supporting said fluidized bed tables for oscillation individually from each other;

first drive means for oscillating said upper fluidized bed table;

second drive means for oscillating said lower fluidized bed table;

a housing enclosing said fluidized bed tables, said housing including an air inlet below said lower table and an air outlet above said upper table;

means defining a product inlet at the upper end of said upper fluidized bed table;

means defining a first outlet at the lower end of said upper fluidized bed table for receiving a light grain fraction;

means defining a second outlet located between said product inlet and said first outlet;

said upper fluidized bed table including at least two sequentially arranged perforate regions located between said product inlet and said second outlet for allowing heavy impurities and medium and heavy grain fractions to fall therethrough;

means defining a floor underlying at least a portion of the perforate regions of said upper fluidized bed table for directing the medium heavy grain fraction into the second outlet;

means defining a third outlet at the upper end of said lower fluidized bed table for receiving the heavy impurities; and means defining a fourth outlet at the lower end of said lower fluidized bed table for receiving the heavy grain fraction.

24. The contrivance of claim 23, wherein said housing includes a plurality of serially arranged channels disposed between said upper fluidized bed table and the air outlet, and further including:

adjustable dampers disposed in the channels of said housing.

25. The contrivance of claim 23, wherein said means for supporting said fluidized bed tables is adjustable to permit adjustment of the inclination of said tables.

26. The contrivance of claim 23, wherein said upper fluidized bed table further includes a transverse slot of predetermined width located between the two perforate regions for allowing any stones in the product to fall therethrough onto said lower fluidized bed table.

27. Contrivance for separating grain products into multiple grain fractions and impurities, which comprises:

upper and lower fluidized bed tables located in superposed relationship each of said fluidized bed tables being inclined and having an upper end and relatively lower opposite end;

means for supporting said fluidized bed tables for oscillation individually from each other;

drive means for separately oscillating each of said fluidized bed tables;

a housing enclosing said fluidized bed tables, said housing including an air inlet below said lower table and an air outlet above said upper table;

means defining a product inlet at the upper end of said upper fluidized bed table;

means defining a first outlet at the lower end of said upper fluidized bed table for receiving a light grain fraction;

means located between said product inlet and said first outlet defining a second outlet;

said upper fluidized bed table including at least two sequentially arranged perforate regions located between said product inlet and said second outlet for allowing heavy impurities and medium and heavy grain fractions to fall therethrough;

means defining a floor underlying at least a portion of the perforate regions of said upper fluidized bed table for directing the medium heavy grain fraction into the second outlet;

said floor means being comprised of plurality of serially arranged adjustable dampers;

means defining a third outlet at the upper end of said lower fluidized bed table for receiving the heavy impurities; and means defining a fourth outlet at the lower end of said lower fluidized bed table for receiving the heavy grain fraction.

* * * * *